US007008239B1

(12) United States Patent
Ju

(10) Patent No.: US 7,008,239 B1
(45) Date of Patent: Mar. 7, 2006

(54) SOCKET MOUNTED ON PRINTED CIRCUIT BOARD

(76) Inventor: Ted Ju, P.O. Box 26-757, Taipei 106 (TW)

( * ) Notice: Subject to any disclaimer, the term of this patent is extended or adjusted under 35 U.S.C. 154(b) by 0 days.

(21) Appl. No.: 10/986,546

(22) Filed: Nov. 12, 2004

(51) Int. Cl.
*H01R 12/00* (2006.01)

(52) U.S. Cl. ..... 439/71; 439/66

(58) Field of Classification Search ..... 439/66, 439/71, 55, 91, 591
See application file for complete search history.

(56) References Cited

U.S. PATENT DOCUMENTS 5,171,290 A * 12/1992 Olla et al. ..... 439/71
5,221,209 A * 6/1993 D'Amico ..... 439/71
5,342,205 A * 8/1994 Hashiguchi ..... 439/66
5,791,914 A * 8/1998 Loranger et al. ..... 439/71
6,179,624 B1 * 1/2001 McHugh et al. ..... 439/71

* cited by examiner

*Primary Examiner*—Michael C. Zarroli
(74) *Attorney, Agent, or Firm*—Rosenberg, Klein & Lee

(57) ABSTRACT

A socket mounted on a printed circuit board (PCB), which includes a plurality of pads and at least two soldering areas, includes an insulative housing, a plurality of contacts corresponding to the pads and received in the slots respectively, at least two screw nuts and at least two screws mating with the screw nuts. The insulative housing has a plurality of slots and a border projected therefrom and around the slots for orientating an electronic component. The contacts have an end exposed out of the slots and are bent, and a topmost portion of the contacts is lower than a top surface of the border. The screw nuts are adjacent to the border of the insulative housing and are relative to the soldering area, so as to connect the insulative housing to the PCB via the screw nuts. The screws force the electronic component downward to electrically connect the PCB.

4 Claims, 5 Drawing Sheets

SOCKET MOUNTED ON PRINTED CIRCUIT BOARD

BACKGROUND OF THE INVENTION

1. Field of the Invention

The present invention relates to a socket, and particularly relates to a socket adapted for a land grind array IC module.

2. Background of the Invention

As synthetic applications for system technologies, such as multi-media, communication or computer technologies, develop, their functions grow more and more and the layout of PCBs (printed circuit boards) become more and more complex. Within a notebook, particularly one which has limited space for arranging all elements and components therein, the design and the layout of the PCB are extremely important.

Referring to FIGS. 8 and 9, that show a conventional socket electrically connected to an IC module 500 and a PCB 600. A conventional socket includes a metallic upper hous ing 100, a metallic lower housing 200 and a lever 300, which connect to the metallic upper housing 100 and the metallic lower housing 200. In actual practice, the lever 300 occupies much room irrespective of whether it lies along the horizontal or vertical direction. Furthermore, the operation of the lever 300 interferes with other components on the PCB 600. For example, the fastening of the IC module 500 via the lever 300 will force the metallic lower housing 200 to become deformed, so that the electrical connection between the IC module and the PCB will be affected.

Hence, an improvement over the prior art is required to overcome the disadvantages thereof.

SUMMARY OF INVENTION

The primary objective of the invention is therefore to specify a socket that guarantees an excellent connection between an IC module and a PCB and occupies less space than the conventional socket.

According to the invention, the objective is achieved by a socket mounted on a printed circuit board (PCB) in order to orientate an IC module. The socket includes an insulative housing, a plurality of contacts, at least two screw nuts and at least two screws. The insulative housing has a plurality of slots and a border projected therefrom and around the slots for orientating an electronic component. The contacts correspond to the pads and are received in the slots, respectively. The contacts further have an end exposed out of the slots and are bent. A topmost portion of the contacts is lower than a top surface of the border. The screw nuts are adjacent to the border of the insulative housing and are relative to the soldering area, so as to connect the insulative housing to the PCB via the screw nuts. The screws mate with the screw nuts and force the electronic component downward to electrically connect to the PCB. Therefore, an excellent connection between the component and the PCB is guaranteed, and the arrangement occupies a smaller space than the prior art.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Figure 1:
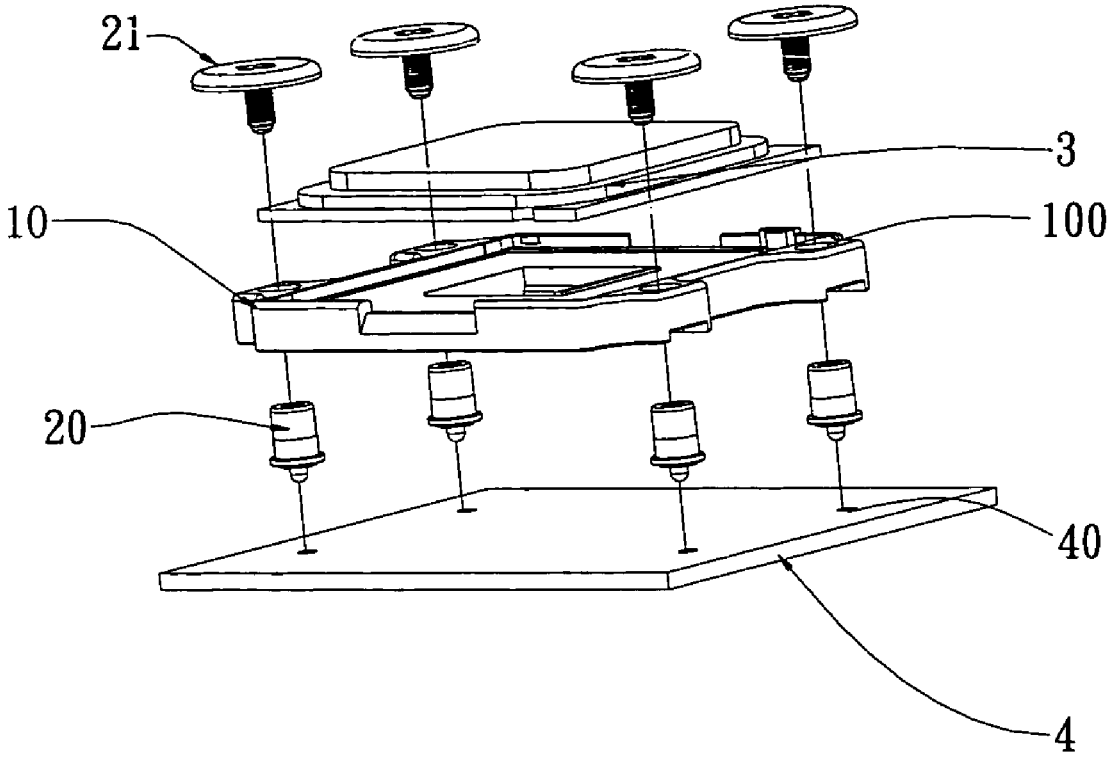
FIG. 1 is a decomposition view of a socket with an IC module and a PCB according to the present invention.
Figure 2:
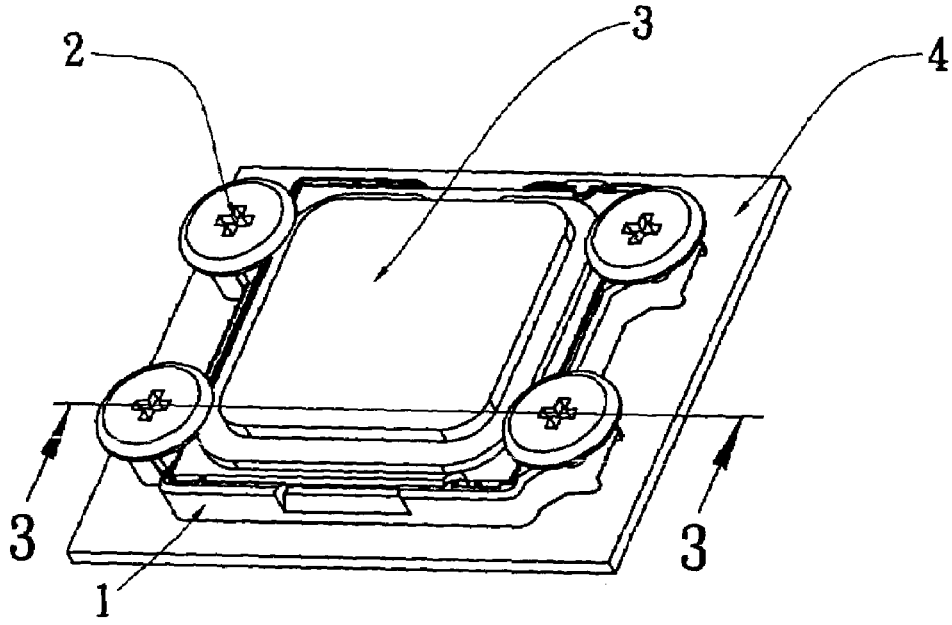
FIG. 2 is a perspective view of the socket with the IC module and the PCB according to the present invention.
Figure 3:
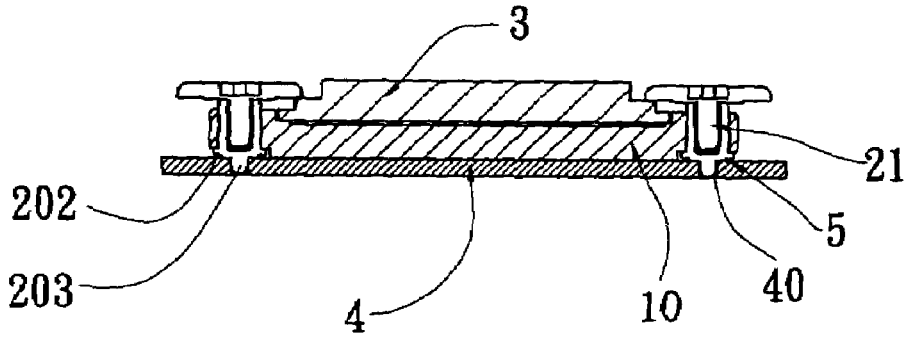
FIG. 3 is a cross-sectional profile along line A—A according to FIG. 2.

FIGS. 1 to 3 show a socket according to the present invention mounted on a printed circuit board (PCB) 4 which includes a plurality of pads and at least two soldering areas. The socket includes an insulative housing 10, a plurality of contacts, at least two screw nuts 20 and at least two screws 21. The insulative housing 10 has a plurality of slots and a border projected therefrom and around the slots for orientating an electronic component, such as an IC module 3. The contacts correspond to the pads and are received in the slots, respectively. The contacts have an end exposed out of the slots and are bent, and a topmost portion of the contacts is lower than a top surface of the border. The screw nuts 20 are adjacent to the border of the insulative housing 10 and relative to the soldering area, so as to connect the insulative housing 10 to the PCB 4 via the screw nuts 20. The screws 21 mate with the screw nuts 20 and force the electronic component 3 downward to electrically connect with the PCB 4. Therefore, an excellent connection between the component 3 and the PCB 4 is guaranteed, and the arrangement occupies a small space.

The screw nuts 20 have a solder end 202 electrically connecting the soldering pads, the solder end 202 has at least one dent embedded with a solder ball 5 (or another shape), in order to guarantee the evenness of the surface of the IC module 3 and to increase the solder quality between the IC module 3 and the PCB 4. The screw nuts 20 have a solder end 202 electrically connecting the soldering pads, the solder end 202 has a guide pillar 203 extending downward, and the PCB 4 has a hole 40 corresponding to the guide pillar 203 so as to receive the guide pillar 203.

During the assembly process, the screw nuts 20 are secured into holes of the insulative housing 10, and the insulative housing 10 with the screw nuts 20 is soldered onto the PCB 4. The IC module 3 is then disposed inside the insulative housing 10 so that the IC module electrically connects with the contacts in the insulative housing 10. The head of each screw 21 presses the top surface of the IC module 3 for orientating the IC module 3 in the insulative housing 10. The solder end 202 is disposed at the same side with the screw nuts 20.

Figure 4:
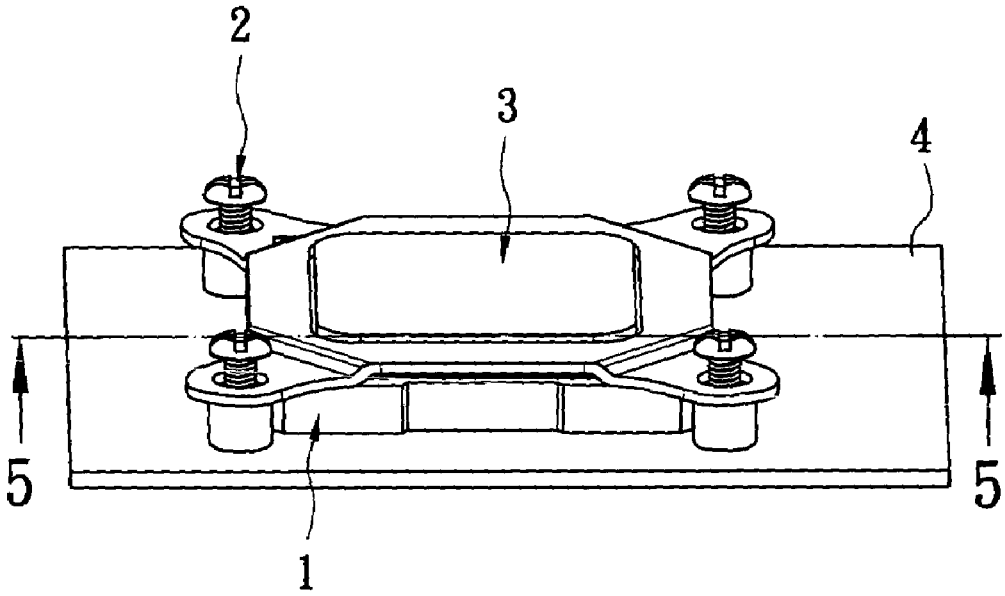
FIG. 4 is a perspective view of the socket with the IC module and the PCB according to a first embodiment of the present invention.
Figure 5:
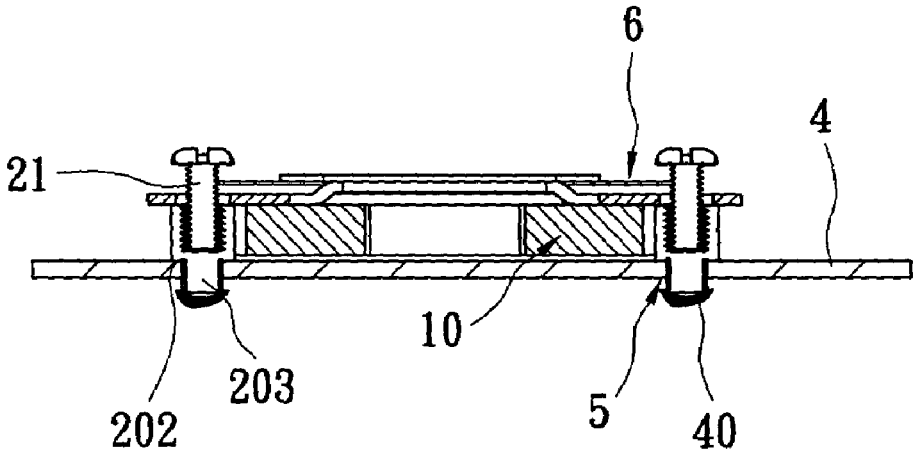
FIG. 5 is a cross-sectional profile along line A—A according to FIG. 4.

A lid 6 is arranged between the screws 21 and the insulative housing 10 in FIGS. 4 and 5.

Figure 6:
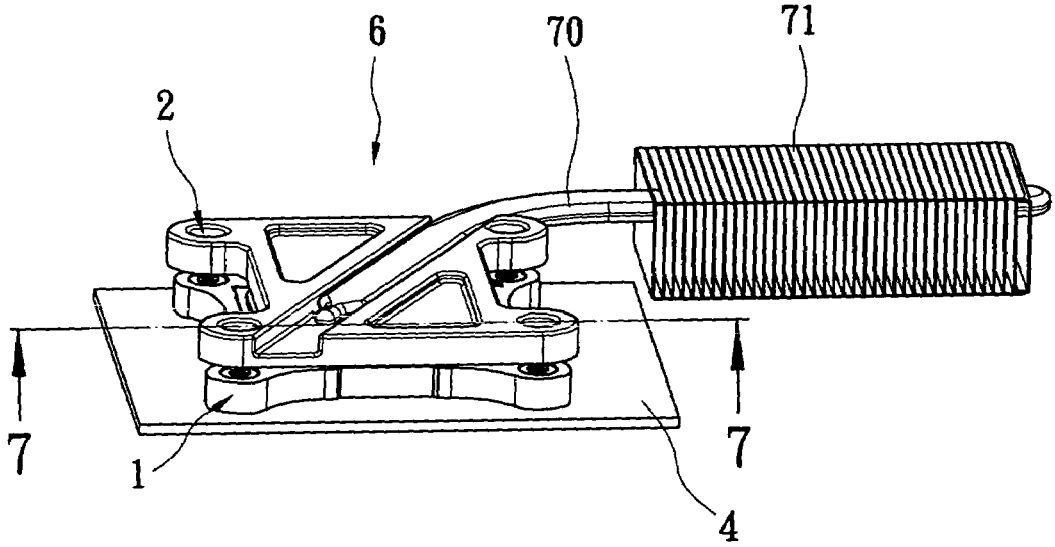
FIG. 6 is a perspective view of the socket with the IC module and the PCB according to a second embodiment of the present invention.
Figure 7:
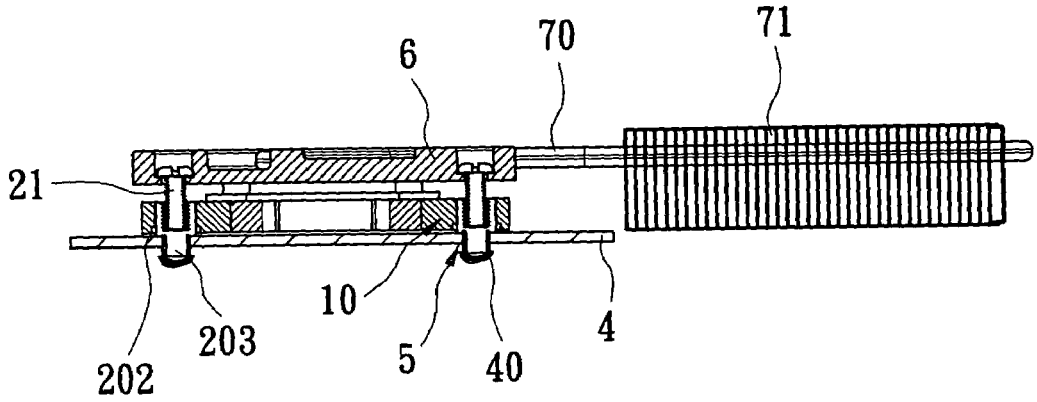
FIG. 7 is a cross-sectional profile according to FIG. 6.
Figure 8:
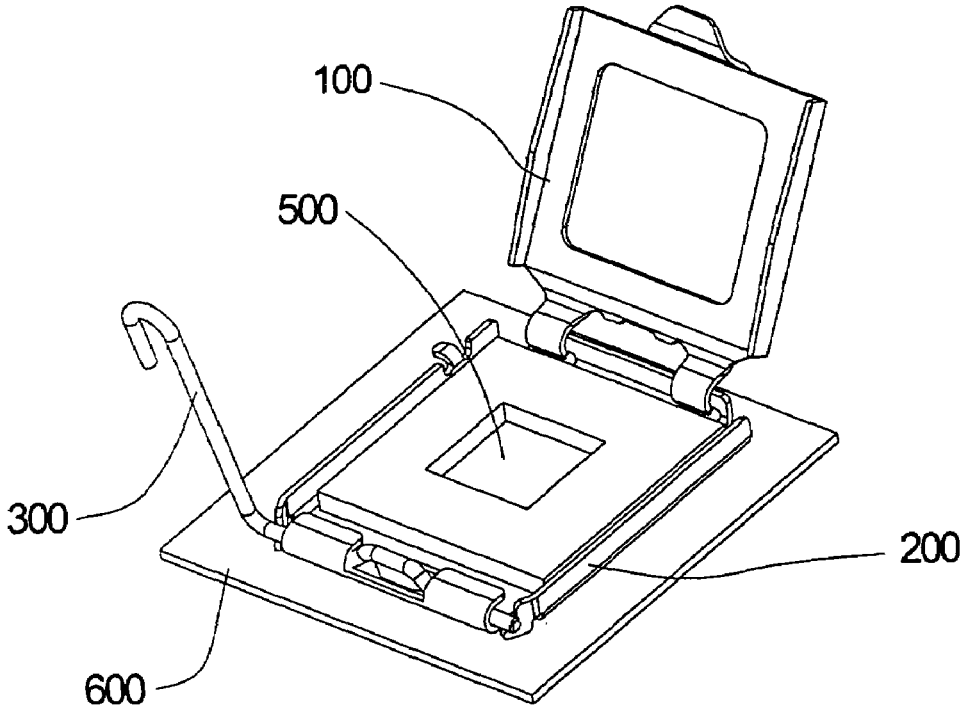
FIG 8 PRIOR ART
FIG. 8 is a perspective view of a conventional socket with an IC module and a PCB.
Figure 9:
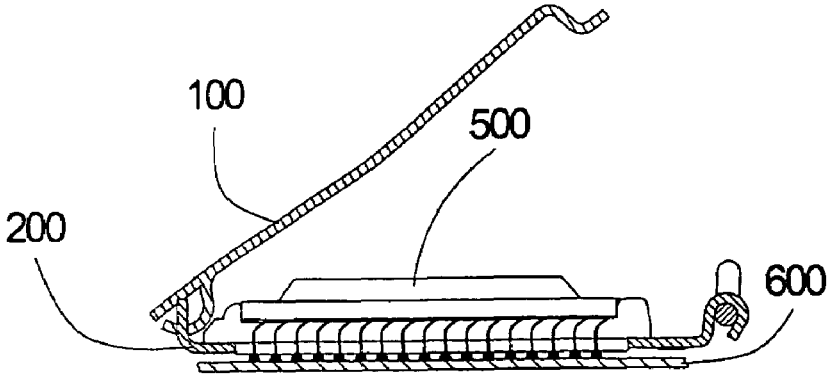
FIG 9 PRIOR ART
FIG. 9 is a side view of the conventional socket with the IC module and the PCB.

A heat guide pipe 70 connecting the lid 6 and a heat dissipation device 71 connecting an end of the heat guide pipe 70 are illustrated in FIGS. 6 and 7 for further heat dissipation.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A socket mounted on a printed circuit board (PCB), which includes a plurality of pads and at least two soldering areas, and the socket comprising:

an insulative housing having a plurality of slots, and a border projected therefrom and around the slots for orientating an electronic component, a plurality of contacts corresponding to the pads and received in the slots, respectively; wherein the contacts have an end exposed out of the slots and are bent, and a topmost portion of the contacts is lower than a top surface of the border;

at least two screw nuts being adjacent to the border of the insulative housing and relative to the soldering area, so as to connect the insulative housing to the PCB via the screw nuts said screw nuts including a solder end electrically connecting with the pads, the solder end having at least one dent embedded with a solder ball; and at least two screws mating with the screw nuts and forcing the electronic component downward to electrically connect to the PCB.

2. The socket as claimed in claim 1, wherein the screw nuts have a solder end electrically connecting with the soldering pads, the solder end has a guide pillar extending downwardly, the PCB has a hole corresponding to the guide pillar so as to receive the guide pillar.

3. The socket as claimed in claim 1, further including a lid arranged between the screws and the insulative housing.

4. The socket as claimed in claim 3, further including a heat guide pipe connecting the lid and a heat dissipation device connecting with an end of the heat guide pipe.

* * * * *